US010526819B2

(12) United States Patent
Erices et al.

(10) Patent No.: US 10,526,819 B2
(45) Date of Patent: Jan. 7, 2020

(54) MOTOR VEHICLE LOCK WITH A POSITION SECURING SYSTEM

(71) Applicant: Kiekert AG, Heiligenhaus (DE)

(72) Inventors: Bernardo Erices, Bergisch-Gladbach (DE); Nicolas Cavalie, Le Port Marly (FR); Madhu S. Basavarajappa, Dusseldorf (DE)

(73) Assignee: Kiekert AG, Heiligenhaus (DE)

( * ) Notice: Subject to any disclaimer, the term of this patent is extended or adjusted under 35 U.S.C. 154(b) by 446 days.

(21) Appl. No.: 15/111,918

(22) PCT Filed: Jan. 15, 2015

(86) PCT No.: PCT/DE2015/100023
§ 371 (c)(1),
(2) Date: Aug. 18, 2016

(87) PCT Pub. No.: WO2015/110119
PCT Pub. Date: Jul. 30, 2015

(65) Prior Publication Data

US 2016/0348405 A1 Dec. 1, 2016

(30) Foreign Application Priority Data

Jan. 22, 2014 (DE) ..... 10 2014 000 680

(51) Int. Cl.
*E05B 77/06* (2014.01)
*E05B 77/04* (2014.01)
(Continued)

(52) U.S. Cl.
CPC ..... *E05B 77/06* (2013.01); *E05B 15/0053* (2013.01); *E05B 15/04* (2013.01);
(Continued)

(58) Field of Classification Search
CPC ..... E05B 15/0053; E05B 15/04; E05B 2015/0066; E05B 2015/0496;
(Continued)

(56) References Cited

U.S. PATENT DOCUMENTS 3,799,596 A 3/1974 Nozomu et al.
6,948,745 B2 * 9/2005 Chevalier ..... E05B 77/28 292/201
(Continued)

FOREIGN PATENT DOCUMENTS

DE 4108561 A1 9/1992
DE 103 20 457 A1 12/2004
(Continued)

OTHER PUBLICATIONS

Computer Generated Translation for DE 202012007232 U1, Generated on Nov. 1, 2019, https://worldwide.espacenet.com/ (Year: 2019).*
(Continued)

*Primary Examiner* — Alyson M Merlino
(74) *Attorney, Agent, or Firm* — Renner, Otto, Boisselle & Sklar, LLP

(57) ABSTRACT

The invention relates to a door lock or flap lock comprising a locking mechanism that has a rotary latch and a pawl for locking the rotary latch. Said type of lock is also described in DE 103 20 457 A 1. The aim of the invention is to provide a lock with a position securing system with low technical complexity. Said aim is achieved by a lock with a locking mechanism comprising a rotary latch and a pawl for locking the rotary latch. The lock comprises a position securing system for a locking or anti-theft device. A spring is used for securing the position. Said spring is embodied as a dual-acting clamping spring. A tilting mechanism tilts a slot thus securing the position of the slot if excessively accelerated.
(Continued)

As a result, an undesired movement of the slot is inhibited and the position thereof is thus improved.

13 Claims, 3 Drawing Sheets

(51) Int. Cl.
*E05B 81/06* (2014.01)
*E05B 15/00* (2006.01)
*E05B 15/04* (2006.01)
*E05B 77/28* (2014.01)

(52) U.S. Cl.
CPC ..... *E05B 77/04* (2013.01); *E05B 81/06* (2013.01); *E05B 77/28* (2013.01); *E05B 2015/041* (2013.01)

(58) Field of Classification Search
CPC ..... E05B 2015/041; E05B 2015/0403; E05B 2015/0406; E05B 2015/0427; E05B 2015/0437; E05B 2015/0451; E05B 2015/0486; E05B 77/02; E05B 77/04; E05B 77/06; E05B 77/28; E05B 81/06; Y10T 292/1082; Y10T 292/1047; Y10T 292/1021; Y10T 292/1078; Y10S 292/22; Y10S 292/23; Y10S 292/61; Y10S 292/65
See application file for complete search history.

(56) References Cited

U.S. PATENT DOCUMENTS

2002/0050156 A1* 5/2002 Kobayashi ..... E05B 77/28 70/237
2006/0186676 A1* 8/2006 Fukunaga ..... E05B 81/06 292/216
2006/0261602 A1 11/2006 Jankowski et al.
2006/0261603 A1 11/2006 Cetnar et al.
2007/0085349 A1 4/2007 Merideth et al.
2008/0111381 A1 5/2008 Merideth et al.
2009/0243308 A1* 10/2009 Ishiguro ..... E05B 81/06 292/196
2011/0162419 A1* 7/2011 Akizuki ..... E05B 77/28 70/141
2011/0254287 A1* 10/2011 Akizuki ..... E05B 81/06 292/223
2015/0323954 A1* 11/2015 Suzumura ..... E05B 15/0053 74/470
2016/0208524 A1* 7/2016 Erices ..... E05B 15/0053

FOREIGN PATENT DOCUMENTS

DE 10 2008 020433 A1 10/2009
DE 202010010577 U1 11/2011
DE 10 2010 040522 A1 3/2012
DE 10 2011 018 512 A1 10/2012
DE 102011090019 A1 7/2013
DE 202012007232 U1 10/2013
DE 10 2013 212 896 1/2015
FR 2 918 693 A1 1/2009
WO WO 2004/101920 A1 11/2004

OTHER PUBLICATIONS

International Search Report and Written Opinion for corresponding Patent Application No. PCT/DE2015/100023 dated Jul. 28, 2015.

* cited by examiner

MOTOR VEHICLE LOCK WITH A POSITION SECURING SYSTEM

FIELD OF THE INVENTION

The invention relates to a latch for a door or flap with a locking mechanism, comprising a catch and a pawl for locking the catch. Such a latch is disclosed in DE 103 20 457 A1.

BACKGROUND OF THE INVENTION

An actuating means is provided for opening the latch. Upon actuation of the actuating means, the locking mechanism is opened. A handle of a door or a flap can be part of the actuating means. This handle is generally connected to an actuating lever of the latch by means of a rod assembly or a Bowden cable. Upon actuation of the handle, the actuating lever of the latch is pivoted by means of the rod assembly or of the Bowden cable in such a way that the latch opens.

Latches of motor vehicles are generally equipped with a central locking (see for instance DE 4108561 A1) and/or an anti-theft device (see, for instance, DE 10 2011 018 512 A1). In order to lock a side door latch and/or engage an anti-theft device, respective mechanisms are provided that generate a rotational or linear movement and thus lock or unlock the latch or engage or release the anti-theft device.

In the event of an accident, movement of the latch or of the anti-theft device should be avoided, i.e. for instance, movement from a locked position to an unlocked position or in case of an anti-theft device, movement from an engaged position into a released position.

In order to prevent a latch or an anti-theft device from moving its position in the event of an accident or crash, the German patent application 10 2013 212 896 discloses that one or two legs of a spring have to be moved against the force of the spring in order to be able to move the position of the latch or of an anti-theft device. The greater the force required for moving such a spring leg, the greater the acceleration has to be in the event of a crash in order to be able to move the position of an anti-theft device or of a latch. Depending on the spring force it can thus be achieved that in case of accelerations of up to 30 g or up to 55 g the position of an anti-theft device or of a central locking cannot be changed. The letter g stands for gravitational acceleration. The spring leg or spring legs assist the position securing system with securing the position of a latch or the position of an anti-theft device in the event of high accelerations, as those potentially experienced in the event of a crash.

The position securing system disclosed in German patent application 10 2013 212 896 contains a bolt with a symmetrical cross section clasped by the two legs of a pincer spring. In order to change the position of the latch or anti-theft device, the bolt must be displaced relative to the legs of the spring.

The position of a lock or of an anti-theft device is regularly changed by means of a motor, when required. The presence of a position securing system requires a certain motor output in order to overcome the position securing system, i.e. to move the legs of the spring legs in said example.

The above characteristics can individually or in any combination be a part of the latch of the invention.

SUMMARY OF THE INVENTION

The present invention aims to provide a latch with a reliable and compact position securing system.

The task of the invention is solved by providing a latch with the characteristics of the first claim. Advantageous embodiments are disclosed in the dependent claims.

In order to solve the task, a latch, in particular for a motor vehicle, is provided that contains a latch mechanism, such as a locking mechanism with a catch and pawl for locking the catch. Furthermore, a position securing system is provided, in particular for a latch or anti-theft device with the aid of which the position of a displaceably mounted slide can be secured. The displaceably mounted slide can be moved to and fro by sliding between two end positions. The position securing system contains a tilting device for the slide, able to tilt the slide in case of excessive acceleration experienced in the event of a crash and around the direction of movement. The slide is mounted in such a way that a tilting movement increases frictional forces occurring during movement of the slide. As a result of the tilting movement relative to its guide, movement of the displaceably mounted slide along its direction of movement is therefore decelerated. This deceleration advantageously contributes to reliably securing the position of the slide. In particular, it prevents an unscheduled change of the slide's end position, i.e. that the slide is moved from one end position to the next.

In an embodiment of the invention featuring a simple design, the position securing system contains a spring. If the position of the slide is changed in the intended manner, i.e. the slide is moved from one end position to the other end position, one leg of the spring is temporarily deflected or deformed. The deflection or deformation of the spring leg against the spring force required for moving the position, secures the position of the slide.

Preferably, the spring is a pincer spring acting on both sides. A spring is a pincer spring acting on both sides if two legs of the spring have to be moved and, generally at the same time, in order to be able to change the end position of the slide. In contrast to a spring acting on one side, this design advantageously allows, as required, easy movement of the position of the slide and thus also movement of the latch or anti-theft device associated therewith with little force. The comparison is based on the respective position securing system being able to withstand equally high acceleration forces.

In one advantageous embodiment of the invention, a bolt protruding from the slide is tilted by the tilting device, in order to decelerate unplanned movements of the slide. In this way, a simple design ensures that the slide can be tilted, i.e. pivoted to decelerate the movement.

In one embodiment, the bolt deflects at least one leg of a spring when the slide is moved from one intended end position to another end position. In particular, the bolt extends to between the two legs of a pincer spring.

In an advantageous embodiment of the invention, the bolt abuts two legs of a pincer spring in such an offset manner or abuts one leg of a spring and an opposing guide for the bolt in such an offset manner that it is tilted when the slide is moved together with the bolt. This embodiment provides a tilting device for the slide with little effort.

In an embodiment with a simple design, the bolt has a non-symmetrical cross section. As a result, only a simple design is required for an offset arrangement of the bolt, permitting the desired tilting movement.

In one embodiment of the invention, the bolt only abuts in one end position of the slide in such an offset manner that a tilting movement is caused when the slide is moved in the direction of the other end position. This embodiment achieves that only one of the two end positions is particularly well secured against excessive acceleration and thus against displacement in the event of a crash. In motor vehicles, generally only one of two positions has to be secured in such a manner that this position does not change even in the event of a crash. This design advantageously keeps the power required for a desired movement to a minimum as a noticeable deceleration effect only occurs in one direction of displacement.

In one embodiment, the slide contains a bolt as a guide, said bolt extending into a slot. When the slide is moved from one end position to the other end position, the bolt moves along the slot to guide the slide. When the bolt is tilted together with the slide, the bolt jams inside the slot and decelerates the movements of the slide.

In one embodiment, the latch contains one electric drive for a planned movement of the slide. As a tilting device contributes to securing the position, additional position adjustment means do not have to provide comparatively high forces as in the aforementioned prior art embodiments in order to counteract a change of position of the slide. As a result, the position securing system can, in particular, contain a relatively weakly dimensioned spring. Despite of this, the position securing system can secure the position of the slide also in the event of high acceleration. Consequently, a respectively smaller electric drive can be used, keeping the required installation space to a minimum. In addition, the required electric power can be reduced accordingly in comparison to the aforementioned prior art in order to be able to change the end position of the slide in the desired manner.

One embodiment contains a motor with the aid of which the position of the latch or the position of the anti-theft device can be changed. Compared to embodiments in which a spring acting on one side is used as position securing system, a motor with comparatively low power can be used. Consequently, a motor with a comparatively small design and low weight can be used. As a result, the required installation space and weight as well as the technical design are reduced to a minimum.

Preferably, a stop is provided for at least one spring leg or both spring legs of a spring or pincer spring, limiting the movement of the spring legs. This contributes to being able to use a relatively weakly dimensioned spring, i.e. a spring with a small spring constant, whilst still providing a position securing system that can also withstand high accelerations of, for instance, up to 30 g or up to 55 g.

A leg spring in the sense of the present invention also exists if it contains a two-part design. It is then only essential that two legs are provided that both have to be moved against the force of the spring to be able to adjust the end position of the slide in order, for instance, to be able to lock or unlock the latch or to be able to change the position of an anti-theft device. Preferably a, single-part spring is, however, used as in this case the technical production effort can be reduced to a minimum.

Movement or deflection of a leg in the sense of the invention also exists when not all of a leg but only a section of a leg is moved. A deformation of a leg is thus also a movement of the leg or deflection of the leg in the sense of the present invention.

In one embodiment, the bolt is linearly moved or can be linearly moved to change the position of a latch or of an anti-theft device. This embodiment allows a particular reliable functioning of the position securing system. A position securing system requiring a particularly small installation space can thus be provided. This, too, advantageously contributes to being able to use a weakly dimensioned spring with a small spring constant, whilst nevertheless providing a position securing system that can also withstand high levels of acceleration.

In one embodiment, both ends of each leg of a leg spring are fixed. This advantageously contributes to being able to use a weakly dimensioned spring whilst still being able to provide a position securing system that can also withstand high levels of acceleration.

In order to minimize technical complexity, an identical spring is always used for providing a plurality of position securing systems and which is, preferably, always installed in an identical manner so that the spring tension is always the same. In order to secure a position under different accelerations, depending on the requirement, bolts or cylindrical pins with different diameters and/or different cross sections, are used. The same force of the spring, able to act on the bolt and different diameters and/or different cross section designs, results in different force profiles. The forces that a position securing system is able to withstand can be set by the selection of the bolt as required, whilst using the same mechanism.

In order to produce position securing systems with identical spring force that can nevertheless withstand different acceleration forces, it is possible to use bolts with differently designed cross sections. It is also possible to use a bolt with a cross section that is not circular, in order to thus provide position securing systems able to withstand different forces. Installing a bolt with a cross section that does not have a circular symmetry as described, with a different alignment in order to be able to withstand different acceleration forces, is equivalent to using bolts with different diameters.

In one advantageous embodiment, the diameter of the bolt is wedge-shaped. This wedge shape allows a temporary deflection of a spring leg in one direction of movement with comparatively little force due to the wedge effect, in order to be able to adjust the end position of the slide. Greater force is required in the reverse direction. This embodiment contributes to being able to further reduce the power required for a planned movement of the slide. In a motor vehicle it is after all generally important to only secure one of two possible end positions of the slide in such a way that the slide does not change its position in the event of a crash.

In an advantageous embodiment, a drive wheel of a drive rests on a surface of the slide for a planned movement of the slide. This prevents the slide from being tilted and thus decelerated during a planned movement of the end position of the slide by the drive. Advantageously, the drive wheel is a gear wheel engaging in zigzag or wave-shaped surface of the slide. This design particularly reliably allows a planned change of the slide with little required force.

Advantageously, the drive wheel resting on the surface, is arranged below a spring, causing the tilting. Particularly preferred, the drive wheel is arranged between the spring and the surface of the slide and abutting the side of a bolt that can be tilted by the spring, in such a way that a tilting movement is not prevented.

The drive wheel is located, in particular, below and at a constricted point of the spring, i.e. below the area of the spring leg, responsible for the tilting. The drive wheel extends up to this constricted point but not or only insignificantly beyond it, so that a tilting movement of the slide by the tilting device is possible in the event of an excessively high acceleration.

BRIEF DESCRIPTION OF THE DRAWINGS

Below, the invention is explained in more detail with reference to Figures, in which.

DETAILED DESCRIPTION OF THE INVENTION

Figure 1:
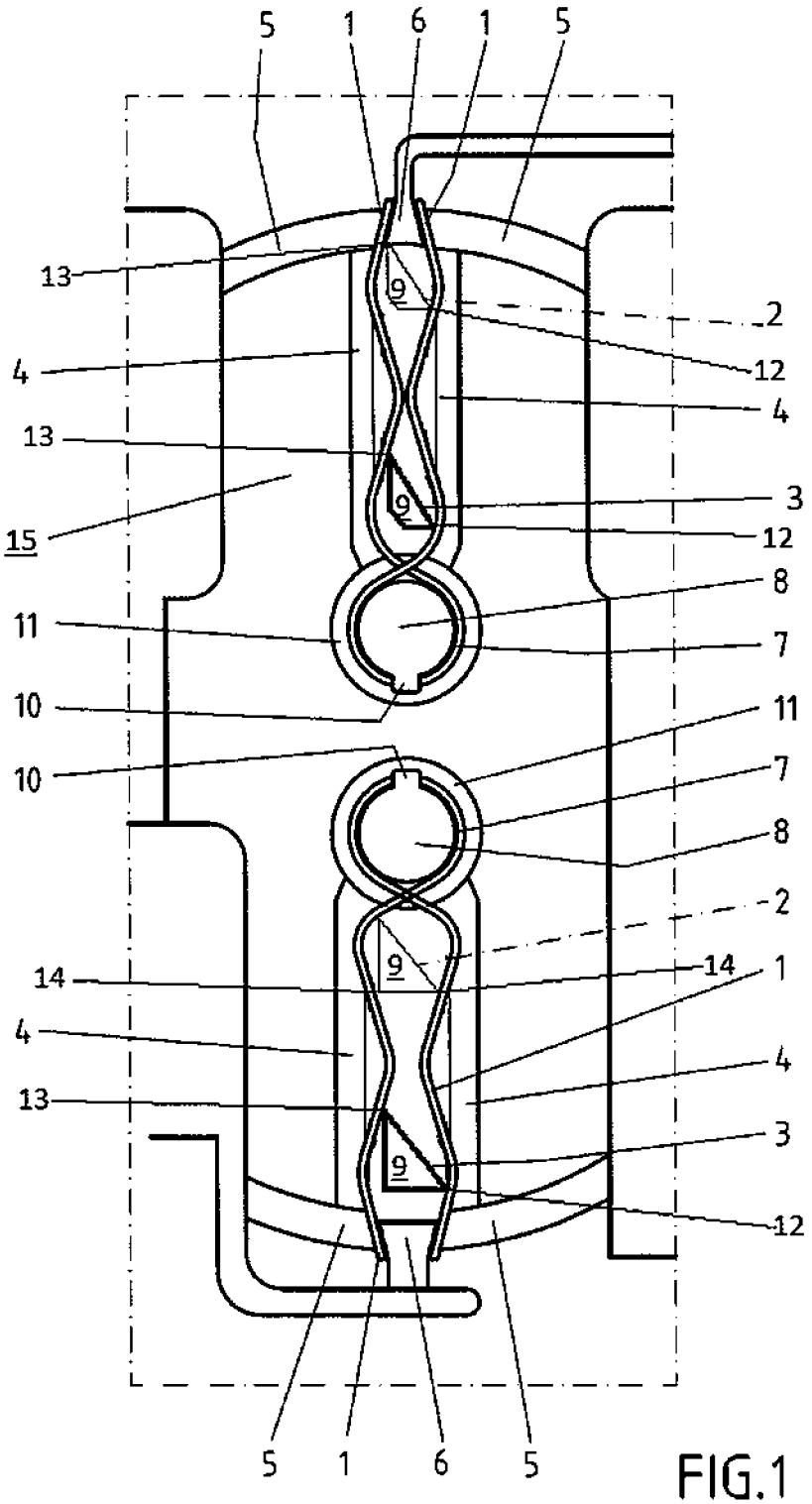
FIG. 1: shows position securing systems.

FIG. 1 shows position securing systems with two pincer springs acting on both sides with in each case two wave-shaped spring legs 1. The wave shape of the legs 1 produces two end positions 2 and 3 for a bolt 9. The legs 1 of each spring clasp or surround a bolt 9 in its respective end position 2 or 3. The bolt 9 can be linearly slid to and fro between a position or place 2 and a position or place 3. The bolt 9 is connected to a slideably mounted slide 16—not shown in FIG. 1. In order to move from one end position 2 to another end position 3 or vice versa, the legs 1 of an—in this case single-piece pincer spring—can be pressed apart in a middle area between the two positions 2 and 3, i.e. deflected and against the tension of the spring. This middle area forms a constricted point, separating one end position 2 from the other end position 3. Each end position or end point 2, 3 of each bolt 9 is thus secured by the two legs 1 of the spring.

The movement of the legs 1 towards the outside can be restricted by the walls 4, serving as a stop. They limit the movements of the legs 1, caused by a displacement of the position of a bolt 9 from 2 to 3 or vice versa. This achieves that a bolt 9 is secured against displacement during high acceleration without the requirement for excessively large springs, i.e. springs with high spring constants. In each case, two walls 4 extend parallel to each other and parallel to the length of the associated spring with legs 1. Two walls 5 serve to retain or fix the free ends of the legs 1. A wall area 6 between the two legs 1 of a spring in the area of the free ends also serves to retain or fix the free ends of the legs 1. The free ends of the legs 1 are, in particular, positively and non-positively retained or fixed by the walls 5 and 6.

The other end 7 of each single-piece spring, opposite the free end of the legs 1, extends circular around a bolt 8 of the housing 15. A web 10, laterally extending from the bolt 8 contributes to positively retain the end 7 of each spring. The end 7 is also enclosed by a wall 11, also contributing to a positive retention of the end 7 of each spring. The end 7 is thus also fixed.

When a latch is unlocked by an actuating lever, a bolt 9 is, for instance, moved from a position 3 to a position 2. The spring with the legs 1 prevents that such a movement and an associated unlocking can occur solely as a result of high accelerations, such as in case of a crash.

FIG. 1 shows an upper position securing system and a lower position securing system. Mechanically, both position securing systems are identical apart from the bolt 9. Diagonally to the direction of displacement, the bolt 9 of the upper position securing system has a smaller cross section than the bolt of the lower position securing system. Due to the smaller cross section, the upper position securing system is less able to withstand acceleration forces than the lower position securing system.

The lower bolt 9 shown in FIG. 1, contains a triangular cross section, so that when in the end position 3, the bolt 9 abuts the legs 1 of the spring in an offset manner and in the direction of displacement, i.e. in the direction of position 2. In case of position 3, the bolt 9 abuts initially, when viewed in the direction of position 2, against the bottom right of position 12 and offset thereto on the left side further up at position 13. As a result of this offset arrangement, movement of the bolt 9 in the direction of the end position 2 causes a torque to be introduced into bolt 9, triggering a tilting movement. This also applies for the upper bolt 9 with a smaller diameter, whose cross-sectional area is, however, trapezoidal, as shown in FIG. 1.

Once the bolt 9 with its trapezoidal cross section has reached its end position 2, this results again in two contact areas 12 and 13, offset in such a way that the bolt 9 is tilted, when the bolt 9 is moved back into its end position 3. This does, however, not apply to the bolt 9 with the larger triangular cross section, when it is in its end position 2. This results in two opposing contact areas 14 which, when viewed in the direction of position 3, do not abut in an offset manner. When bolt 9, shown in the bottom half of the Figure, is moved from its end position 2 in the direction of its end position 3, the two spring legs of the spring 1 are initially evenly pushed apart. Consequently, no tipping moment is introduced into the bolt 9. Only once the contact surfaces 14 of the front section of the bolt 9, when viewed in the direction of movement, have passed the constricted point of the spring and the legs 1 of the spring are no longer pushed apart by said front section, can the situation occur, depending on the size, that the legs 1 of the spring act with difference forces on the bolt 9 with the triangular cross section, which can then cause a tilting movement. All in all, less force is, however, required to move the bolt 9 with its large triangular cross section from its end position 2 to its end position 3 than for moving it from its end position 3 to its end position 2. The forces required for a desired changing of the position of the bolt 9 can thus be minimized, depending on the requirement.

In order to be able to introduce a tilting movement in the bolt 9, only one contact area is required, for instance a contact area, 13, when the bolt 9 is moved from its position 3 in the direction of its position 2 in order to introduce a tilting moment in the bolt 9. The existence of two contact areas 12 and 13 on both sides of a bolt, is however, preferable as the bolt 9 is then retained in its position, preventing any unplanned tilting in its end position.

Figure 2:
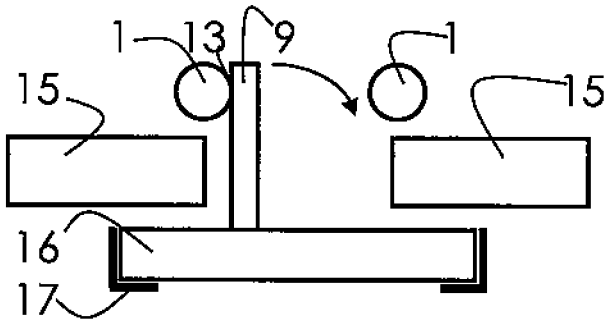
FIG. 2: is a sectional drawing of a position securing system shown in FIG. 1.

FIG. 2 outlines a section through the illustration of FIG. 1 and through the contact area 13 with the bolt 9 being in its end position 3. If the bolt 9 is now moved in the direction of its position 2, the spring leg 1, depicted on the left, introduces a force into the bolt 9 on one side, connected to the slideably mounted slide 16. As a result of the force being introduced on one side, the top end of the bolt 9 is pivoted towards the right. As the bottom end of the bolt 9 is retained by the slide 16, the bolt 9 tilts to the right around its fixing on the slide, as indicated. As a result, the slide 16 is also tilted. The tilting movement causes the slide 16 to jam inside its mounting that can, as shown for instance in FIG. 2, comprise two guide rails 17. This increases frictional forces, decelerating movement of the slide 16. A clearance exists between the guide rails 17 and the slide, so that frictional forces are noticeably lower if the slide 16 is moved along the rails 17 without tilting.

Figure 3:
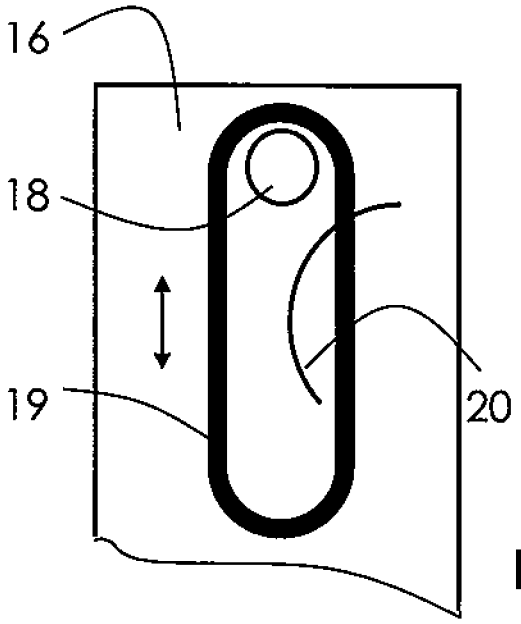
FIG. 3: shows the slotted guide for slides.

As shown in the top view of FIG. 3, the slide can contain a pin 18 for guidance, said pin extending with clearance into a slot 19. The cross section of the bolt can be circular, as shown in FIG. 3. The clearance allows a tilting movement of the slide. The slide is guided by the slot 19 parallel to the length of the slot 19, as indicated by a double arrow. When the slide 16 is tilted, the pin 18 jams inside the slot. This in turn increases frictional forces, decelerating displacement of the slide 16.

A leg 20 of a spring can exist that tilts the pin 20 when the pin 18 is moved from one end of the slot 19 to the other end of the slot 19. Consequently, a tilting movement can be alternatively or additionally provided that can cause tilting of the slide 16, in order to secure the position of the slide by a deceleration process even when exposed to excessive acceleration forces.

Figure 4:
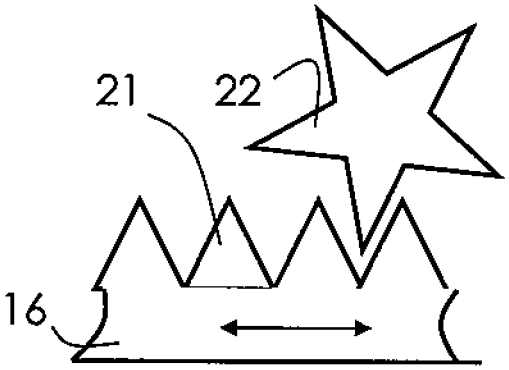
FIG. 4: shows the drive for slides

As outlined in FIG. 4, the slide 16 can contain a wave-shaped or zigzag surface 21. A toothed gear 22 engages in this surface 21. Where the toothed gear 22 is rotated by an electric motor, the slide 16 can, as planned, be moved from one end position to another end position along the double arrow. It has shown that such an electric drive prevents the slide (16) from being tilted, when the slide is, as planned, moved to and fro between its end positions by the electric drive. In the event of a planned drive, deceleration effects caused by tilting are, as far as possible, prevented.

Movement of the end position of the slide 16 serves, in particular, for displacing a locking device or an anti-theft device.

Figure 5:
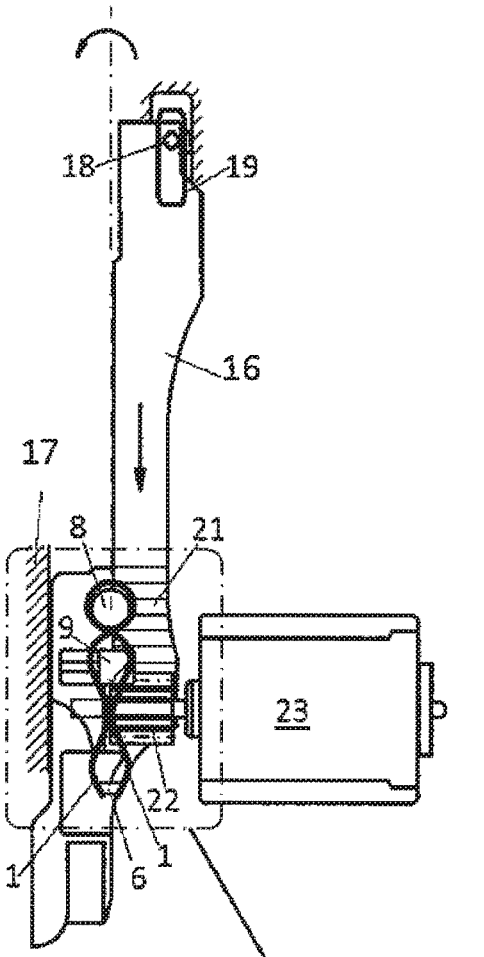
FIG. 5: is a top view of the slide with drive and position securing system
Figure 6:
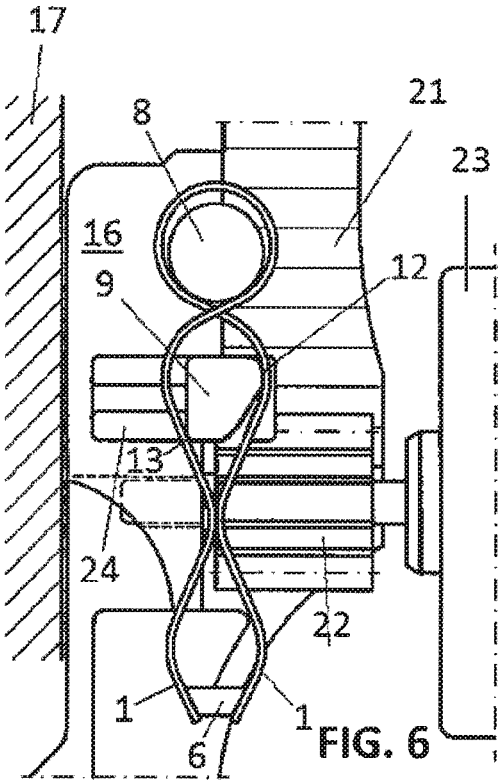
FIG. 6: shows a detailed view of FIG. 5.

FIGS. 5 and 6 show an overall view of a potential design and a detailed view from the top onto the slide 16. A motor 23 exists with the aid of which the position of the slide 16 can be changed. A toothed gear 22 connected to the shaft of the motor 23, rests on a wave-shaped surface 21 of the slide 16. The toothed wheel 22 is located between the pincer spring with its legs 1 and, in particular, below the constricted point of the spring 1. The toothed wheel extends up to the constricted point of the spring but not beyond it, in order to allow a tilting movement of the slide 16. Tilting movements are prevented when the electric motor 23 changes the position of the slide 16. Due to the offset contact of the bolt 9 on the legs 1, the slide tilts, as shown by the top arched arrow in FIG. 5, when the slide is accelerated along the straight arrow in case of a crash.

The bolt 9 is fixed to the slide 16 by means of its arm 24. The arm 24 allows the toothed wheel 22 to be arranged below the spring with legs 1 but above the slide surface 21.

The invention claimed is:

1. A latch comprising:

a guide;

a displaceably mounted slide moveable along the guide between a first end position and a second end position during normal operation of the latch; and a position securing system for the slide with which the slide is secured in the first end position or in the second end position, wherein the positioning securing system contains a tilting device connected to the slide and configured for tilting the slide relative to the guide in response to excessive acceleration, whereby frictional forces between the guide and the slide are increased for preventing movement of the slide between the first end position and the second end position during the excessive acceleration to secure the slide in the first end position or in the second end position.

2. The latch according to claim 1, wherein the position securing system contains a pincer spring having two legs.

3. The latch according to claim 2, wherein the tilting device contains a tiltable and displaceably guided bolt and/or a pin.

4. The latch according to claim 3, wherein when the slide is in the first end position or the second end position, the bolt rests against the legs of the pincer spring in corresponding locations offset relative to a direction of movement of the slide between the first end position and the second end position during the normal operation of the latch.

5. The latch according to claim 3, wherein the bolt contains a non-symmetrical cross section.

6. The latch according to claim 3, wherein the bolt and/or the pin is fixed to the slide.

7. The latch according to claim 6, wherein the pin extends into a slot with a clearance for guiding movement of the slide between the first end position and the second end position to a length of the slot during the normal operation, wherein the pin is jammed inside the slot when the slide is tilted in response to the excessive acceleration.

8. The latch according to claim 2, further comprising a-walls for restricting movement of the legs of the pincer spring.

9. The latch according to claim 1, further comprising a motor that is configured to move the slide between the first end position and the second end position during the normal operation of the latch.

10. The latch according to claim 9, further comprising a drive wheel that is configured to rest on a surface of the slide for preventing tilting of the slide during the normal operation of the latch and enabling movement of the slide between the first end position and the second end position.

11. The latch according to claim 10, wherein the drive wheel is arranged between a spring of the position securing system and below a constricted point of the spring and/or extends between the constricted point of the spring and a slide surface of the slide.

12. The latch according to claim 1, wherein the position securing system is configured to secure the slide in the first end position or in the second end position during the excessive acceleration forces including acceleration forces between 30 g and 55 g.

13. A latch comprising:

a guide;

a displaceably mounted slide moveable along the guide between a first end position and a second end position during normal operation of the latch;

a motor that is configured to move the slide between the first end position and the second end position during normal operation of the latch; and a position securing system for the slide with which the slide is secured in the first end position or in the second end position, wherein the positioning securing system contains a tilting device connected to the slide and configured for tilting the slide relative to the guide in response to excessive acceleration, whereby frictional forces between the guide and the slide are increased for preventing movement of the slide between the first end position and the second end position during the excessive acceleration.

* * * * *